US006742755B2

(12) United States Patent
Pryor

(10) Patent No.: US 6,742,755 B2
(45) Date of Patent: Jun. 1, 2004

(54) BEDSIDE BOOK HOLDING APPARATUS

(76) Inventor: Allen C. Pryor, 1326 Roma Rd., Hanahan, SC (US) 29406

( * ) Notice: Subject to any disclaimer, the term of this patent is extended or adjusted under 35 U.S.C. 154(b) by 0 days.

(21) Appl. No.: 09/816,501

(22) Filed: Mar. 26, 2001

(65) Prior Publication Data

US 2001/0035486 A1 Nov. 1, 2001

Related U.S. Application Data

(60) Provisional application No. 60/191,780, filed on Mar. 24, 2000.

(51) Int. Cl.[7] ..... A47B 23/00
(52) U.S. Cl. ..... 248/447; 248/441.1
(58) Field of Search ..... 248/447, 276.1, 248/447.1, 447.2, 444.1, 445, 460, 441.1

(56) References Cited

U.S. PATENT DOCUMENTS 598,689 A * 2/1898 Wilson ..... 248/451
1,236,887 A * 8/1917 Stafford ..... 248/228.6
1,598,569 A * 8/1926 Fitzhugh ..... 108/49
1,797,847 A * 3/1931 Vandagriff ..... 108/49
2,627,694 A * 2/1953 Saecker ..... 248/447
3,103,760 A * 9/1963 Gould ..... 248/445
3,514,066 A * 5/1970 Singleton et al. ..... 248/445
4,021,013 A * 5/1977 Wiersma ..... 248/447.2
4,718,630 A * 1/1988 Richard ..... 248/444.1
5,058,848 A * 10/1991 Ferraro ..... 248/444.1
6,045,107 A * 4/2000 Carlson ..... 248/445

FOREIGN PATENT DOCUMENTS

EP 0566509 A1 * 10/1992

* cited by examiner

*Primary Examiner*—Alvin Chin-Shue
(74) *Attorney, Agent, or Firm*—W. Alex Dallis, Jr.

(57) ABSTRACT

The present invention relates to a bedside book holding apparatus. The invention includes a support frame for a book, magazine or the like, a lamp, angle adjusting means, a swivel arm, an upright support and clamping means for connecting the apparatus to a bed.

4 Claims, 2 Drawing Sheets

BEDSIDE BOOK HOLDING APPARATUS

CROSS-REFERENCE TO RELATED APPLICATIONS

This application claims the benefit of U.S. Provisional Application No. 60/191,780 filing date Mar. 24, 2000, which provisional application is incorporated herein by reference.

STATEMENT REGARDING FEDERALLY SPONSORED RESEARCH OR DEVELOPMENT

Not Applicable.

BACKGROUND OF THE INVENTION

1. Field of the Invention

The present invention relates to a bedside book holding apparatus. The invention includes a support frame for a book, magazine or the like, a lamp, angle adjusting means, a swivel arm, an upright support and clamping means for connecting the apparatus to a bed.

2. Description of the Related Art

Typically individuals simply hold a book or magazine on their chest when reading in bed. Light is provided by a bedside lamp or an overhead light in the room where the bed is located. There are, however, several devices which provide book support or lighting for use in bed or chairs, obviating the need to hold a book or magazine and easing provision of light for reading.

U.S. Pat. No. 5,709,365 to Howard teaches an adjustable book support for use in conjunction with the backboard of a bed. The Howard device includes lamps located on the bottom of the book supporting platform and is connected to the backboard of the bed by twin arm assemblies, one on each side of the book supporting platform.

U.S. Pat. No. 4,021,013 to Wiersma teaches a book holding device which also is used in conjunction with the backboard of a bed. Like the Howard device, the Wiersma device includes a lamp, though it is located at the top of the plate-like support member for the book, and is connected to the backboard of the bed by mounting means shown as two arms, one on each side of the plate-like support member for the book.

The problem with using one's hands to hold a book is that the hands can become tired by such action. The problem with using a bedside lamp or overhead light is that it may be necessary to leave the bed or to reach a great distance to turn such lamp or light off.

These problems are eliminated by both Howard and Wiersma. Unfortunately such devices present other problems. Both Howard and Wiersma disclose devices which must be attached to a backboard of a bed. Not all beds have a backboard. Thus these devices are not usable by all potential users of a bedside book holding apparatus. Secondly the Howard and Wiersma devices as disclosed both require twin arms for support by the backboard. As a result the user is surrounded by the devices when the devices are being used, having the arms on either side of the user's head and the book support in front of the user. This configuration increases the likelihood that the user might accidentally hit the device as the user moves about which at a minimum would be disconcerting and could cause dislodgment of the book from the device or even injury to the user. Additionally the resulting encapsuling of the user within the device might create a claustrophobic discomfort. Finally the Howard and Wiersma devices cannot be swiveled over to either side of the bed, but instead can only be adjusted vertically. As a result they disturb the aesthetic appearance of the bed backboard and create, even when not in use, a structure which might be in the way of the user's non-reading use of the bed. Since the devices cannot be removed from the bed backboard when not in use, the potential exists for the user to hit the devices when not in use, leading to dislodgment of the devices from the bed backboard, possible damage to the bed backboard itself and possible injury to the user.

BRIEF SUMMARY OF THE INVENTION

It is the object of the present invention to provide a bedside book holding apparatus which eliminates the problems outlined above regarding the existing art. The manner in which each of the shortcomings of the existing art is overcome is set forth hereinafter.

The present invention overcomes the problem presented of requiring the use of a bed backboard by being designed to be attached to the bed frame instead. While not all beds have a backboard, all beds have a frame. Thus the present invention may be used by a wider number of potential users than existing art.

The problem of potential user contact with a device which in effect encircles the user is eliminated by designing the present invention to have only one swivel arm. As a result the user has one side open at all times reducing by at least one-half the potential for accidental user contact with the apparatus. Obviously by leaving at least one side open, the user no longer must face the potential claustrophobic effect of the encircling configuration of the existing art.

Finally the problem of existing art being stored when not in use on the bed backboard is addressed in the present invention by designing the invention to swivel to the side and by designing the invention to attach, not to the bed backboard, but to the bed frame on the side. Attaching the present invention to the bed frame means that there can be no damage to the bed backboard even if there is accidental contact with the apparatus when it is not in use. Obviously the placement of the present invention to the side of the bed means that, unlike with existing art, there is no unsightly contraption attached to the bed backboard when not in use disturbing the aesthetics of the bed backboard and other furniture in the room.

The objects and features of the invention may be further understood with reference to the following detailed description of an illustrative embodiment of the invention taken together with the accompanying drawings in which.

Figure 6A:
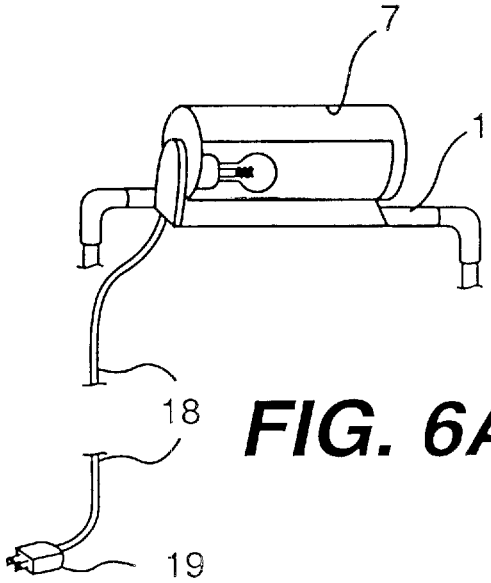
Figure 6B:
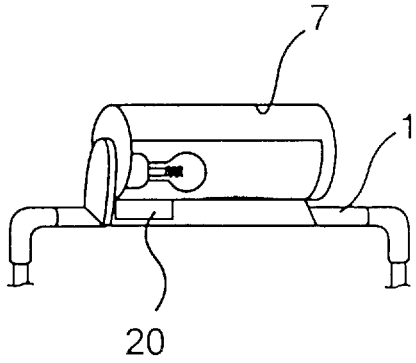

FIGS. 6-A and 6-B show the lamp with alternative power sources.

DETAILED DESCRIPTION OF THE INVENTION

Figure 1:
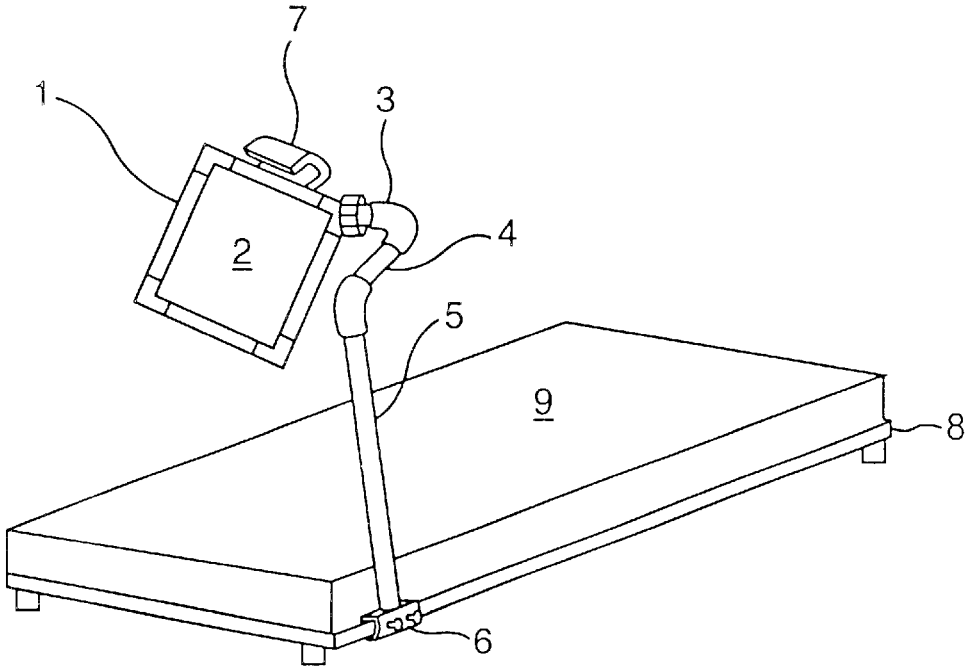
FIG. 1 shows an isometric view of the device attached to a bed.

Turning now descriptively to the drawings in which similar reference characters denote similar elements throughout the several views, FIG. 1 shows the support frame 1 of the invention attached to the support plate 2. The support frame 1 is attached to the swivel arm 4 via an angle adjusting means 3. The angle adjusting means 3 allows the support frame 1 to be rotated so as to adjust the angle at which any book placed upon the support frame 1 is held for the user's comfort and ease of viewing. The swivel arm 4 is then connected swivelly to the upright support 5. This connection of the swivel arm 4 to the upright support 5 allows the user to swivel the support frame 1 away from the user when the invention is not in use. The upright support 5 is then attached to a clamping means 6 which allows the upright support 5 to be clamped to a bed frame 8 upon which rests a mattress 9.

Figure 2:
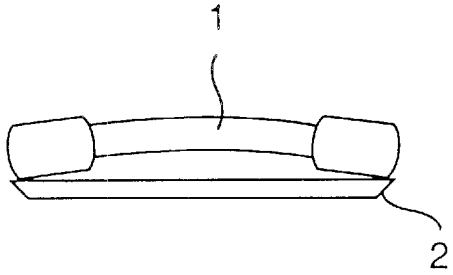
FIG. 2 shows a side view of the upper member of the support frame with the support plate attached, each side view of the members of the support frame being roughly identical to this view with the sole exception of the length dimension.

FIG. 2 shows a how the support plate 2 attaches to the bottom of the support frame 1.

Figure 3:
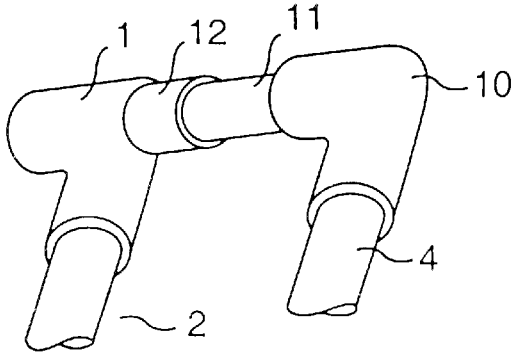
FIG. 3 shows a detail of the angle adjusting means.

FIG. 3 shows at least one embodiment of the angle adjusting means 3, which does not employ screws. Here there is attached to a first end of the swivel arm 4 an adjusting elbow member 10. From the end of the adjusting elbow member 10 opposite the end attached to the swivel arm 4 there is attached a pin 11. The pin 11 fits snugly into a cup 12, which is attached to the upper member of the support frame 1.

Figure 4:
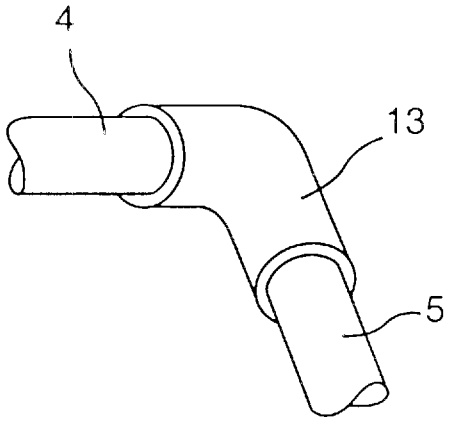
FIG. 4 shows a detail of the connection of the swivel arm to the upright support.

FIG. 4 shows the connection of the upright support 5 to the swivel arm 4 via an arm elbow member 13. The upper end of the upright support 5 is inserted into a cavity defined in the end of the arm elbow member 13. A second end of the swivel arm 4 is attached to the other end of said arm elbow member 13. The swivel arm 4 is swiveled in any needed direction by the user by rotation of the arm elbow member 13 around the upper end of the upright support 5.

Figure 5:
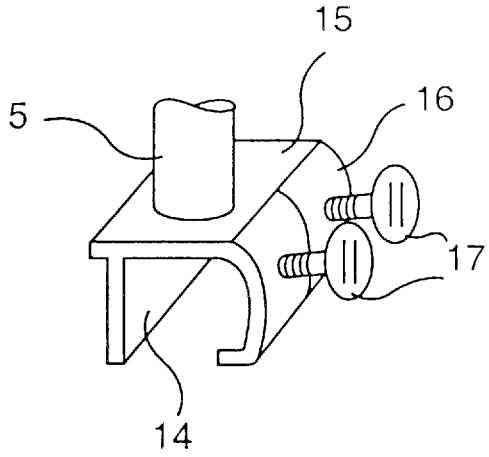
FIG. 5 shows a detail of the clamping means.

FIG. 5 shows one embodiment of the clamping means 6. Here the lower end of the upright support 5 is attached to a channel formed by a top 15, a back 14 and a front 16. The upright support 5 is attached to the top 15. A bed frame may be placed within the channel formed by the top 15, back 14 and front 16. Into the front 16 are defined one or more threaded holes into which may be screwed one or more bolts 17, here shown two in number.

FIG. 6-A shows a lamp 7 attached to the support frame 1 at its upper member. Also shown is the power source 18 for the lamp 7 which is a cord attached to a standard wall plug 19. FIG. 6-B shows an alternative power source 20, which is a receptacle for a battery.

While I have described and illustrated certain embodiments of my invention, it is to be understood that further modifications and improvements are contemplated and may be practiced without departing in any way from the spirit of the invention, for the limits of which reference must be had to the appended claims.

I claim:

1. A bedside book holding apparatus, which comprises:

a. a support frame that is roughly tubular in shape, and roughly rectangular in shape, said support frame having an upper member, two side members and a bottom member;

b. a support plate of the same roughly rectangular shape as said support frame, said support plate having an upper surface and a lower surface and being attached along said upper surface to said upper member, said side members and said bottom member of said support frame;

c. angle adjusting means for adjusting the angle of said support frame attached to said upper member of said support frame;

d. a single swivel arm roughly tubular in shape having a first end and a second end attached at said first end to said angle adjusting means;

c. a single upright support roughly tubular in shape having an upper end and a lower end swivelly connected at said upper end to said second end of said swivel arm; and f. clamping means for clamping the apparatus to a bed frame, said clamping means attached to said lower end of said upright support; and wherein said angle adjusting means comprises: a) an adjusting elbow member having an arm end, an approximately right-angle elbow and a pin end, attached to said first end of said swivel arm at said arm end of said adjusting elbow member; b) a pin having a frame end and an elbow end and being roughly cylindrical in shape attached at said elbow end to said pin end of said adjusting elbow member; and c) a cup having a closed bottom, said closed bottom of which is attached to said upper member of said support frame and the cavity defined therein being roughly cylindrical in shape and of such dimension that said frame end of said pin inserts snugly into said cup; and wherein said angle adjusting means does not comprise screws.

2. A bedside book holding apparatus as recited in claim 1 further comprising a lamp attached to said upper member of said support frame and a power source for said lamp.

3. A bedside book holding apparatus as recited in claim 2 wherein said clamping means comprises:

a. a channel having a back, a top and a front, said channel being of such dimensions to allow placement therein of a bed frame member, said top of said channel being attached to said lower end of said upright support such that said back and said front of said channel extend downward away from said upright support and into said front there being defined one or more threaded holes; and b. one or more bolts having an inner end and an outer end and of size and threading such that each such bolt screws into one each of the threaded holes defined in said front of said channel such that when said bolts are screwed into said channel through the threaded holes defined therein the inner end of each of said bolts touches and holds firmly any bed frame member placed within said channel.

4. A bedside book holding apparatus as recited in claim 2 wherein said clamping means comprises:

a. a channel having a back, a top and a front, said channel being of such dimensions to allow placement therein of a bed frame member, said top of said channel being attached to said lower end of said upright support such that said back and said front of said channel extend downward away from said upright support and into said front there being defined one or more threaded holes; and b. one or more bolts having an inner end and an outer end and of size and threading such that each such bolt screws into one each of the threaded holes defined in said front of said channel such that when said bolts are screwed into said channel through the threaded holes defined therein the inner end of each of said bolts touches and holds firmly any bed frame member placed within said channel.

* * * * *